United States Patent [19]

Hahn

[11] Patent Number: 4,651,371

[45] Date of Patent: Mar. 24, 1987

[54] BED LINENS WITH RELEASABLE FASTENERS

[76] Inventor: Betty K. Hahn, 101 W. 55th St., Apartment 5L, New York, N.Y. 10019

[21] Appl. No.: 772,894

[22] Filed: Sep. 5, 1985

[51] Int. Cl.[4] ..... A47G 9/04

[52] U.S. Cl. ..... 5/497; 5/490; 5/496

[58] Field of Search ..... 5/485, 490, 495, 496, 5/497, 482, 486, 499, 500, 501, 502

[56] References Cited

U.S. PATENT DOCUMENTS

| | | | |
|---|---|---|---|
| 1,267,593 | 5/1918 | Roever | 5/499 |
| 1,775,061 | 9/1930 | Bertha | 5/490 |
| 3,083,379 | 4/1963 | Marinsky | 5/496 |
| 3,242,511 | 3/1966 | Fultz et al. | 5/490 X |
| 3,243,827 | 4/1966 | Kintner | 5/496 |
| 3,454,969 | 7/1969 | Lundberg | 5/496 X |
| 4,045,832 | 9/1977 | DiForti et al. | 5/496 |
| 4,538,312 | 9/1985 | Marki et al. . | |

FOREIGN PATENT DOCUMENTS

| | | | |
|---|---|---|---|
| 463763 | 3/1950 | Canada | 5/496 |
| 862179 | 3/1961 | United Kingdom | 5/497 |

*Primary Examiner*—Carl D. Friedman
*Assistant Examiner*—R. Chilcot
*Attorney, Agent, or Firm*—Monty L. Ross

[57] ABSTRACT

Bed linens comprising bed sheets with releasable corner fasteners adapted to releasably secure sheet to an underlying mattress by means of pressure actuated, releasably adherent strips disposed so as to be brought into facing and contacting alignment when secured around the mattress, and pillow cases with releasable end fasteners adapted to secure a pillow within the pillow case by means of pressure actuated, releasably adherent strips disposed so as to be brought into facing and contacting alignment after the pillow is inserted into the pillow case.

1 Claim, 19 Drawing Figures

BED LINENS WITH RELEASABLE FASTENERS

TECHNICAL FIELD

This invention relates to bed linens, and more particularly, to bed linens having releasable fasteners. One aspect of the invention relates to fitted sheets having adjustable and releasable corner fasteners that are adapted to fit snugly over mattresses of various thicknesses. Another aspect of the invention relates to fitted sheets with releasable corner fasteners adapted for use with mattresses of different lengths or widths. Yet another aspect of the invention relates to pillow cases having releasable end fasteners.

BACKGROUND OF THE INVENTION

Numerous problems have been encountered in both the manufacture and use of conventional fitted sheets. Conventional fitted sheets typically employ various combinations of seams and/or elastic bands at the corners. The contoured corners thus formed are intended to fit snugly over the corners of an underlying mattress whenever the sheet is in use. Unfortunately, although most mattresses come in lengths and widths that are fairly standard depending upon whether the mattress is twin, full, queen or king size, the thicknesses of the mattresses can vary greatly even for a given type. Such variations are attributable to the methods and materials of construction, including factors such as whether the mattress is foam or innerspring, the type of coil construction for innerspring mattresses, the type and amount of padding, the cover material and stitching patterns, and the welting utilized along the edges between adjoining mattress surfaces. The effective length and width of a mattress can also vary to a lesser extent depending upon the materials and methods of construction utilized.

Because bed linen manufacturers generally produce fitted sheets having a single set of dimensions for each standard bed size, difficulties frequently arise when the sheets are used by the consumer. When the fitted sheets are placed over a relatively thinner or smaller mattress, the corners may not fit snugly, causing the sheet to bunch or wrinkle across the bed surface, making the bed uncomfortable and unattractive. When the sheets are used with relatively thicker or larger mattresses, it is often difficult to stretch the last corner over the mattress, and ripping or tearing of the corner construction may occur, particularly after repeated use and laundering.

Conventional fitted sheets are disclosed, for example, in U.S. Pat. Nos. 3,181,179 and 3,694,832. U.S. Pat. No. 3,181,179 discloses fitted sheets having shoulders cut on each end and side panel which are subsequently sewn together and bordered with elastic strips on their open edges. U.S. Pat. No. 3,694,832 discloses fitted sheets wherein triangular pieces of material are removed from the end and side panels, and the remaining material is folded and sewn to obtain the shaped or fitted corners.

U.S. Pat. No. 4,045,832 discloses an improvement in fitted sheets that provides a greater degree of adjustability through the use of overlying flaps having releasable strips made of a material such as Velcro. The corners are constructed with cutouts through which a portion of the mattress corner extends when the sheet is in use. However, the sheets disclosed in U.S. Pat. No. 4,045,832 are constructed using stitched darts in combination with the partially open corners and the releasable closure strips.

The use of stitched darts and/or elastic to form the fitted corners as disclosed in the foregoing patents requires the use of manufacturing procedures that are more complicated and expensive than would be needed if such stitching were not required. Furthermore, sheets made in such manner cannot be laid out flat, and are therefore more difficult to fold, package and store.

The use of Velcro fasteners with sheets is also disclosed in U.S. Pat. Nos. 3,832,743 and 4,241,466. These patents disclose the use of releasable fasteners for separably fastening one edge of a top sheet to a side or end panel of an underlying bottom sheet to prevent the top sheet from coming loose or untucked during use.

Problems have also been encountered with pillow cases in that pillows can work back out the open ends through which they are inserted during use. Particular concerns arise with pillows that are used by commercial establishments, in airplanes, or the like, where health and sanitation regulations may require that the pillow be secured within the pillow case. Some pillow cases and pillow shams have been constructed with flaps that are adapted to be stretched over the outward facing corners of the pillow after it is inserted. Such pillow cases are more expensive to produce, are difficult to use, and require additional seams that may rip or tear with repeated use. Pillow cases are therefore needed that are adapted to releasably secure pillows within pillow cases with minimal time, effort and expense.

SUMMARY OF THE INVENTION

According to the present invention, bed linens are provided that are adapted by means of adjustable, releasable fasteners to be quickly installed over or removed from mattresses and pillows. The bed linens of the invention are designed and constructed so as to be easily manufactured, folded and stored. Furthermore, they are not as susceptible to ripping or tearing as conventional fitted sheets and pillow cases.

According to one embodiment of the invention, a fitted sheet is provided having a V-type releasable corner fastener.

According to another embodiment of the invention, a fitted sheet is provided that has a wrap-type releasable corner fastener.

According to another embodiment of the invention, a fitted sheet is provided that comprises corners having a side-slit releasable corner fastener.

According to another embodiment of the invention, a two-size adjustable fitted sheet is provided that has corners comprising a side-slit releasable corner fastener.

According to another embodiment of the invention, a pillow case is provided having a pinch-type releasable end fastener.

According to another embodiment of the invention, a pillow case is provided comprising a folded pinch-type releasable end fastener.

BRIEF DESCRIPTION OF THE DRAWINGS

The invention is further described and explained in relation to FIGS. 1–19 below.

FIG. 1 is a broken away perspective view of one corner of a fitted sheet having a V-type releasable corner fastener, shown in the flat position.

FIG. 2 depicts a broken away perspective view of one corner of a fitted sheet having a V-type releasable corner fastener, shown draped over a mattress and in a partially secured position.

FIG. 3 depicts a broken away perspective view of one corner of a fitted sheet having a V-type releasable corner fastener, shown in a fully secured position.

FIG. 4 is a broken away perspective view of one corner of a fitted sheet having a wrap-type releasable corner fastener, shown in the flat position.

FIG. 5 depicts a broken away perspective view of one corner of a fitted sheet having a wrap-type releasable corner fastener, shown draped over a mattress and in a partially secured position.

FIG. 6 depicts a broken away perspective view of one corner of a fitted sheet having a wrap-type releasable corner fastener, shown in a fully secured position.

FIG. 7 is a broken away perspective view of one corner of a fitted sheet having a side-slit, wrap-type releasable corner fastener, shown in the flat position.

FIG. 8 depicts a broken away perspective view of one corner of a fitted sheet having a side-slit, wrap-type releasable corner fastener, shown draped over a mattress in a partially secured position.

FIG. 9 depicts a broken away perspective view of one corner of a fitted sheet having a side-slit, wrap-type releasable corner fastener, shown in a fully secured position.

FIG. 10 is a broken away perspective view of one corner of a fitted sheet having an adjustable width, side-slit, wrap-type releasable corner fastener, shown in the flat position.

FIG. 11 depicts a broken away perspective view of one corner of a fitted sheet having an adjustable width, side-slit, wrap-type releasable corner fastener, shown partially secured on a queen size mattress.

FIG. 12 depicts a broken away perspective view of one corner of a fitted sheet having an adjustable width, side-slit, wrap-type releasable corner fastener, shown partially secured around a queen size mattress.

FIG. 13 depicts a broken away perspective view of one corner of a fitted sheet having an adjustable width, side-slit, wrap-type releasable corner fastener, shown partially secured around a queen size mattress.

FIG. 14 depicts a broken away perspective view of one corner of a fitted sheet having an adjustable width, side-slit, wrap-type releasable corner fastener, shown fully secured around a king size mattress.

FIG. 15 depicts a broken away perspective view of the open end of a pillow case having pressure adherent releasable end fasteners, shown in the unsecured position.

FIG. 16 depicts a broken away perspective view of the open end of a pillow case having pressure adherent releasable end fasteners, shown in the fully secured position.

FIG. 17 depicts a broken away perspective view of the open end of a pillow case having a foldable flap with pressure adherent releasable end fasteners, shown in the fully extended and unsecured position.

FIG. 18 depicts a broken away perspective view of the open end of a pillow case having a foldable flap with pressure adherent releasable end fasteners, shown in the partially folded position.

FIG. 19 depicts a broken away perspective view of the open end of a pillow case having a foldable flap with pressure adherent releasable end fasteners, shown in the fully folded and secured position.

Like numbers are used to designate like parts in all figures of the drawings. In FIGS. 1–14, the length direction of the sheet is designated with an arrow identified by the letter L and the width direction of the sheet is designated with an arrow identified by the letter W. The dashed lines shown in FIGS. 1–14 are fold lines showing where the sheets of the invention would drape over the edges of an underlying mattress (not shown). In each of FIGS. 1–14, the length and width of the subject sheets as measured between the fold lines at the four corners should generally correspond to the dimensions of the top surface of the standard mattress size with which the sheet is to be used. The distance between the fold lines and the respective edges of the sheet should generally correspond to the thickness dimension of the mattress with which the sheet is to be used.

DESCRIPTION OF THE PREFERRED EMBODIMENT

For purposes of the present invention, the sheets and pillow cases disclosed herein are understood to be manufactured primarily from textile materials. It will be appreciated, however, that the same inventive aspects are similarly applicable to flexible polymeric sheeting materials and to other goods not strictly classifiable as sheets or pillow cases, such as mattress pads, blankets, bed spreads and the like.

Figure 1:
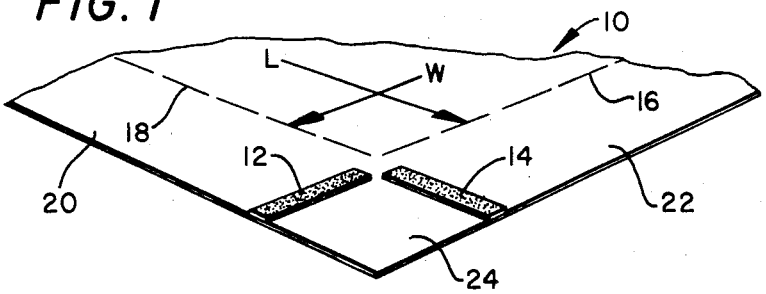
FIGS. 1–14 relate to those embodiments of the invention pertaining to fitted sheets. In each of FIGS. 1–14, one corner of a representative fitted sheet is shown in perspective view, broken away from the remainder of the sheet. It is understood, however, that the materials and construction shown for each embodiment are similarly applicable to the other corners of the sheet as well. For fitted bottom sheets, the releasable corner fasteners of the invention are desirably utilized on all four corners. Where it is desired to make a top sheet that will remain untucked at the head of a bed but will fasten snugly over the bottom sheet and mattress at the foot of a bed, the releasable corner fasteners of the invention are desirably used on only the bottom corners.
Figure 2:
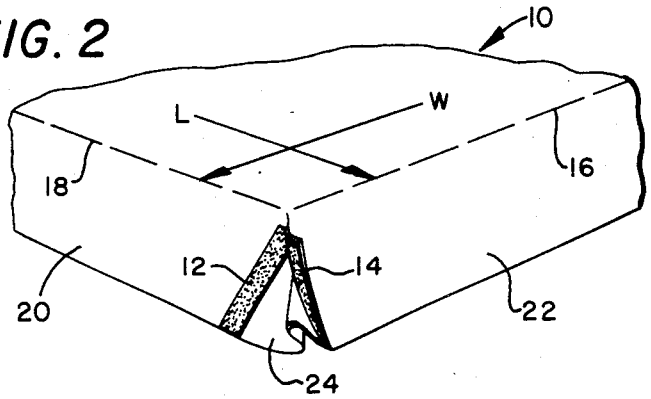
Figure 3:
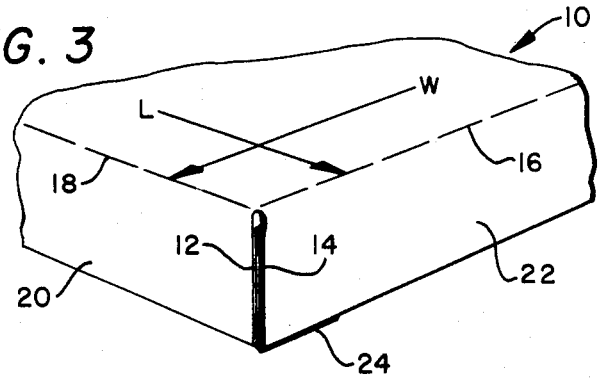

FIGS. 1–3 relate to an embodiment of the invention employing V-type releasable corner fasteners. In FIG. 1, sheet 10 is shown in a flat position, as if extended outwardly past the top surface of an underlying mattress. Releasable fastener strips 12 and 14 are disposed perpendicularly to each other and in general alignment with fold lines 16 and 18 respectively. Releasable fastener strip 12 is attached to side panel 20, and releasable fastener strip 14 is attached to end panel 22 of sheet 10. Releasable fastener strips 12, 14 are preferably made of Velcro, or some other similarly effective pressure adherent, releasable fastening material. They are preferably backed with a fabric tape that will facilitate attachment of the strips to side panel 20 and end panel 22 of sheet 10 by sewing, or the like.

Referring to FIG. 2, side panel 20 and end panel 22 of sheet 10 are draped downwardly from fold lines 16, 18 and sheet material 24 disposed between releasable fastener strips 12, 14 is folded inwardly, so that releasable fastener strips 12 and 14 can be brought into facing and contacting alignment with each other.

Referring to FIG. 3, the corner of sheet 10 is fully secured by applying pressure to that portion of end panel 22 overlying releasable fastener strip 14, which is in fully secured, facing contact with releasable fastener strip 12. Corner material 24 is folded out of sight between end panel 22 of sheet 10 and the end surface of the underlying mattress.

Figure 4:
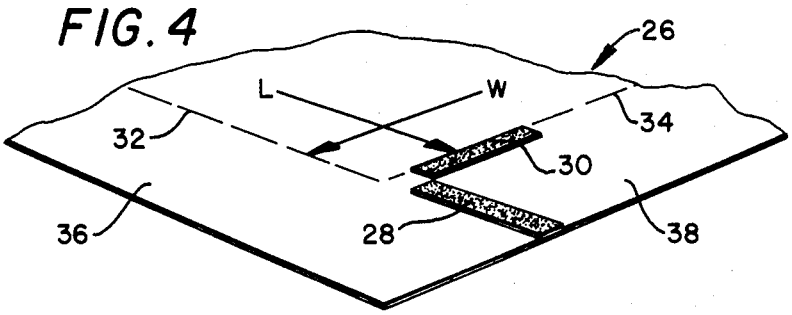
Figure 5:
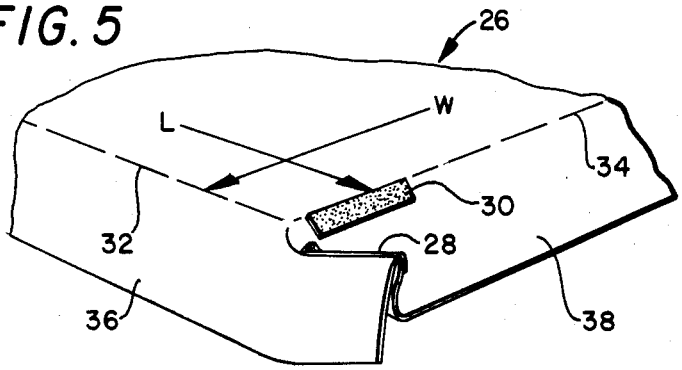
Figure 6:
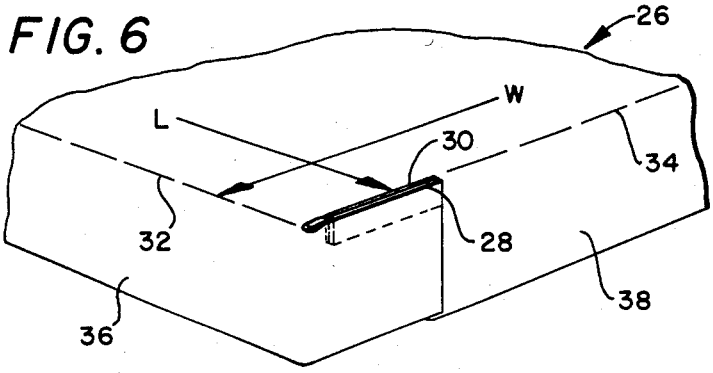

FIGS. 4–6 relate to an embodiment of the invention employing wrap-type releasable corner fasteners. In FIG. 4, sheet 26 is shown in a flat position, as if extended outwardly past the top surface of an underlying mattress. Releasable fastener strips 28, 30 are disposed perpendicularly to each other. Releasable fastener strip 28 is attached to end panel 38 of sheet 26 in general alignment with fold line 32, and fastener strip 30 is attached to end panel 38 adjacent fold line 34. Releasable fastener strips 28, 30 are preferably made of Velcro, or some other similarly effective pressure adherent releasable fastening material. They are preferably backed with a fabric tape that will facilitate attachment of the strips to end panel 38 of sheet 26 by sewing, or the like.

Referring to FIG. 5, side panel 36 and end panel 38 of sheet 26 are draped downwardly from fold lines 32, 34 and releasable fastener strip 28 is brought upward into facing and contacting alignment with releasable fastener strip 30. This causes a portion of end panel 38 to be folded out of sight, and causes a portion of side panel 36 to be wrapped around the corner of the underlying mattress.

Referring to FIG. 6, the corner of sheet 26 is fully secured by applying pressure to that portion of side panel 36 overlying releasable fastener strip 28, which is in fully secured, aligned facing contact with releasable fastener strip 30.

Figure 7:
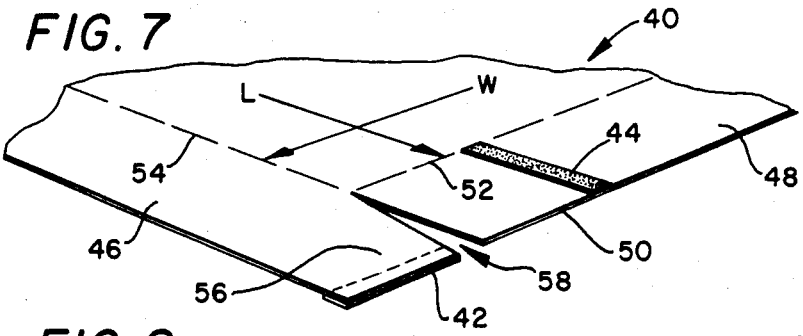
Figure 8:
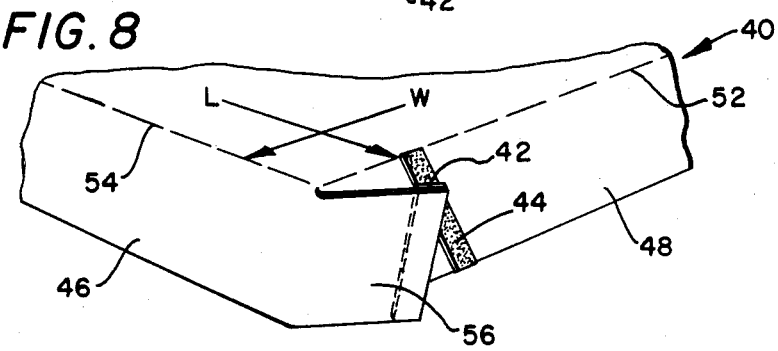
Figure 9:
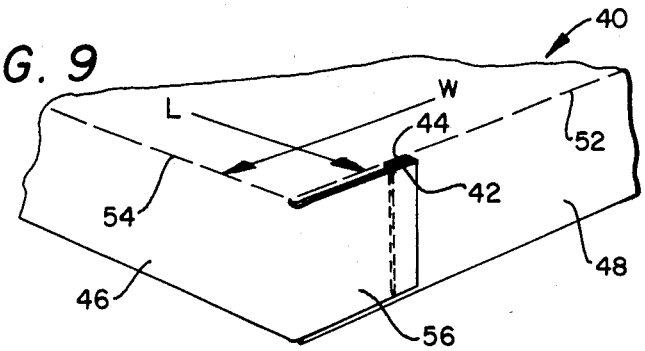

FIGS. 7–9 relate to an embodiment of the invention employing side-slit releasable corner fasteners. In FIG. 7, sheet 40 is shown in a substantially flat position, as if extended outwardly past the top surface of an underlying mattress. Sheet 40 is cut perpendicularly between edge 50 and fold line 52 of end panel 48 so that the resulting cut is aligned with fold line 54, thereby creating flap 56 on the end of side panel 46. Releasable fastener strip 42 is attached to the end of flap 56 so as to be substantially aligned with edge 50 of end flap 48. Releasable fastener strip 44 is disposed perpendicularly to edge 50 and fold line 52 and is attached therebetween to end flap 48 at a distance from slit 58 that is slightly less than the length of the slit.

Releasable fastener strips 42, 44 are preferably made of Velcro, or some other similarly effective releasable fastening material. They are preferably backed with a fabric tape that will facilitate attachment of the strips to end panel 48 and flap 56 of side panel 46, respectively, by sewing, or the like.

Referring to FIG. 8, side panel 46 and end panel 48 of sheet 40 are draped downwardly from fold lines 54, 52 and flap 56 is wrapped around the corner of the underlying mattress so that releasable fastener strip 42 is brought into facing and contacting alignment with releasable fastener strip 44.

Referring to FIG. 9, the corner of sheet 40 is fully secured by applying pressure to that portion of flap 56 that overlies releasable fastener 42, which is in fully secured, facing contact with releasable fastener strip 44. That portion of end panel 58 between releasable fastener strip 44 and slit 58 is thereby held in place between flap 56 and the underlying mattress.

FIGS. 10–14 relate to an embodiment of the invention employing adjustable width, side-slit, wrap-type releasable corner fasteners. The embodiment shown in FIGS. 10–14 is very similar to the embodiment shown in FIGS. 7–9, except that an additional slit is made in the end panel of sheet 60, and four releasable fastener strips are used instead of two. King size mattresses are wider than queen size, but are typically the same length. Fitted sheets having adjustable width, side-slit wrap-type releasable corner fasteners are suitable for use with either width mattress.

Figure 10:
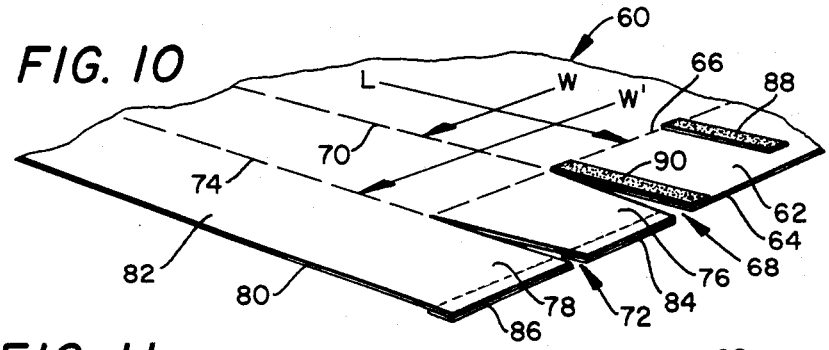

Referring to FIG. 10, sheet 60 is shown in a substantially flat position, as if extended outwardly past the top surface of an underlying mattress. End flap 62 is defined by edge 64 and fold line 66. Slit 68 extends perpendicularly between edge 64 and fold line 66 in alignment with fold line 70, which corresponds to the top edge of the narrower of the two mattresses. Slit 72 is disposed parallel to slit 68, but is aligned with fold line 74, which correspond to the outside edge of the wider of the two mattresses. Flap 76 is thereby formed between slits 68 and 72, and flap is thereby formed between slit 72 and edge 80 of side panel 82. Releasable fastener strips 84, 86 are attached to the underside of flaps 76, 78, respectively, and are disposed perpendicularly to slits 68, 72 adjacent the outwardly extending ends of flaps 76, 78. Releasable fastener strip 88 is attached to the upward facing side of end panel 62 and is disposed perpendicularly between edge 64 and fold line 66 at a distance from slit 68 that is slightly less than the length of the slit. This will permit releasable fastener strip 84 to be brought into facing and contacting alignment with releasable fastener strip 88 when sheet 60 is secured around a mattress of width W. Releasable fastener strip 90 is attached to the upward facing surface of end panel 62 and is disposed perpendicularly between edge 64 and fold line 66 adjacent slit 68. This will permit releasable fastener strip 86 to be brought upward into facing and contacting alignment with releasable fastener strip 90 when sheet 60 is secured around the corner of a mattress of width W'.

Figure 11:
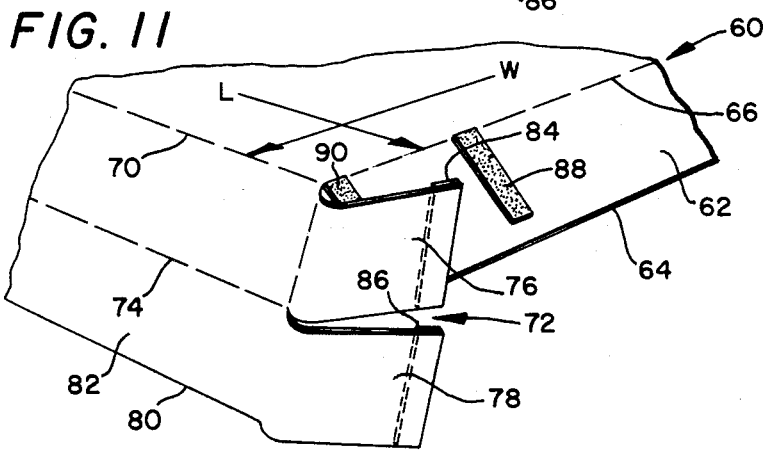

Referring to FIG. 11, side panel 62 and end panel 82 of sheet 60 are draped downwardly from fold lines 66, 70, respectively. In this application, side panel 82 extends upwardly from edge 80 to fold line 70. Flap 76 is thereafter wrapped around the corner of the underlying mattress so as to overlie that portion of end panel 62 between releasable fastener strips 88, 90, and releasable fastener strips 84, 88 are brought into facing and contacting alignment with each other.

Figure 12:
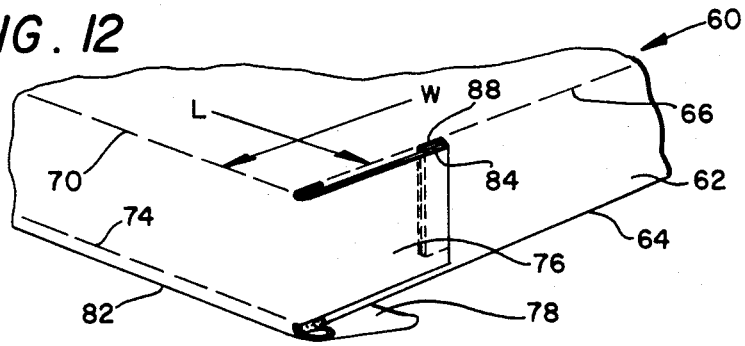

Referring to FIG. 12, the corner of sheet 60 is fully secured by applying pressure to that portion of flap 76 overlying releasable fastener strip 84, which is in fully secured, facing contact with releasable fastener strip 88. Flap 78 and that portion of side panel 82 extending downwardly below edge 64 of end panel 62 can then be folded out of sight under the mattress.

Figure 13:
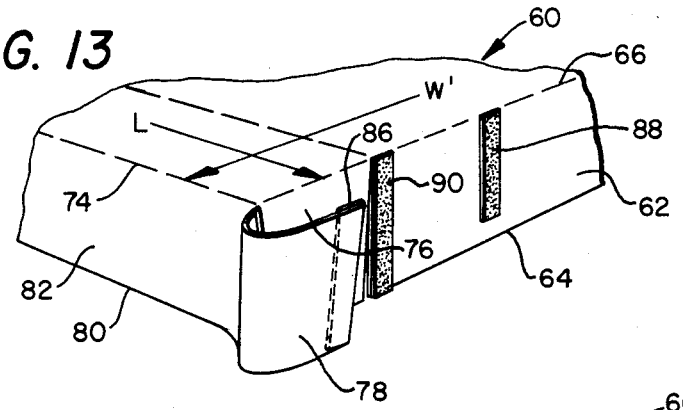

Referring to FIG. 13, side panel 82 extends upwardly from edge 80 to fold line 74. Side panel 82 and end panel 62 of sheet 60 are draped downwardly from fold lines 70 and 66, respectively. Flap 76 hangs downwardly over the end of the underlying mattress and is covered by flap 78 as flap 78 is wrapped around the corner of the underlying mattress, bringing releasable fastener strip 86 into facing and contacting alignment with releasable fastener strip 90.

Figure 14:
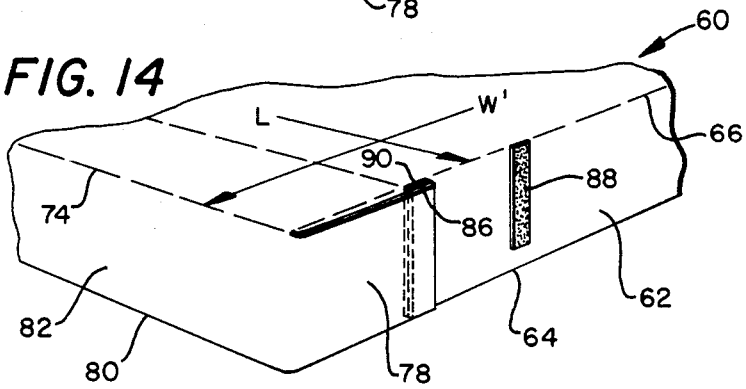

Referring to FIG. 14, the corner of sheet 60 is fully secured by applying pressure to that portion of flap 78 overlying releasable fastener strip 86, which is in fully secured, facing contact with releasable fastener strip 90. Flap 76 is out of sight between flap 78 and the underlying mattress.

Figure 15:
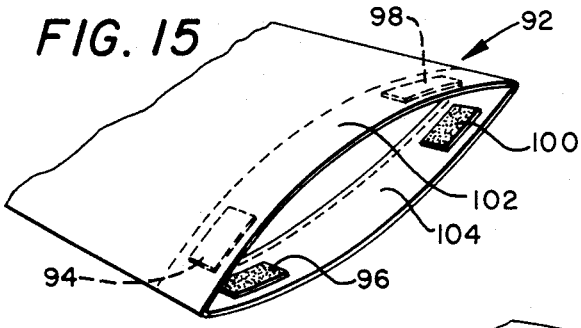
FIGS. 15–19 relate to those embodiments of the invention pertaining to pillow cases.
Figure 16:
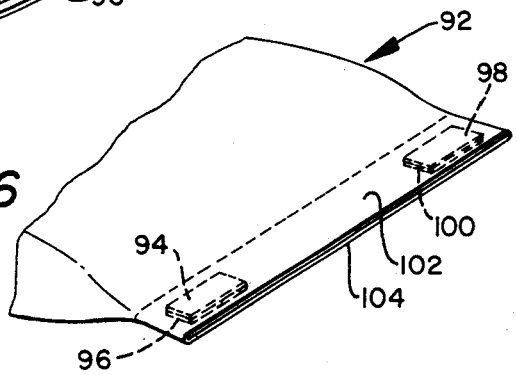

FIGS. 15–19 relate to an embodiment of the invention comprising pillow cases employing releasable end fasteners. Referring to FIG. 15, pillow case 92 is a conventional open-end pillow case that is adapted in accordance with the present invention to have pressure actuated releasable end fasteners, the first fastener comprising fastener strips 94, 96 and the second fastener comprising fastener strips 98, 100. Releasable fastener strips 94, 96, 98, 100 are preferably made of Velcro, or some other similarly effective pressure adherent, releasable fastening material. Releasable fastener strips 94, 96 are attached to the inwardly facing surfaces of upper and lower hemmed edges 102, 104, respectively, and are oppositely disposed. The releasable fastener strips are preferably backed with a fabric tape that will facilitate attachment of the strips to the material of the pillow case. Releasable fastener strips 98, 100 are attached to the inwardly facing surfaces of upper and lower hemmed edges 102, 104, respectively, and are also oppositely disposed. Referring to FIG. 16, after a pillow (not shown) is inserted into pillow case 92 between upper and lower hemmed edges 102, 104, hemmed edges 102, 104 are pressed or pinched together, causing releasable fastener strips 94, 98 to be brought into facing and contacting alignment with releasable fastener strips 96, 100, thereby effectively but releasably securing the pillow within pillow case 92.

Figure 17:
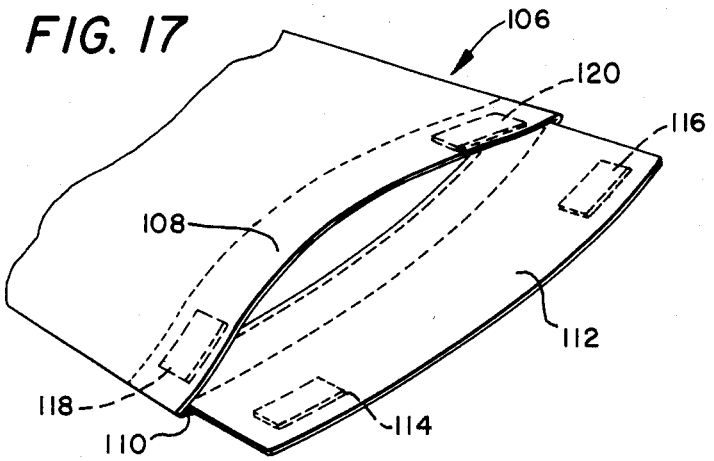
Figure 18:
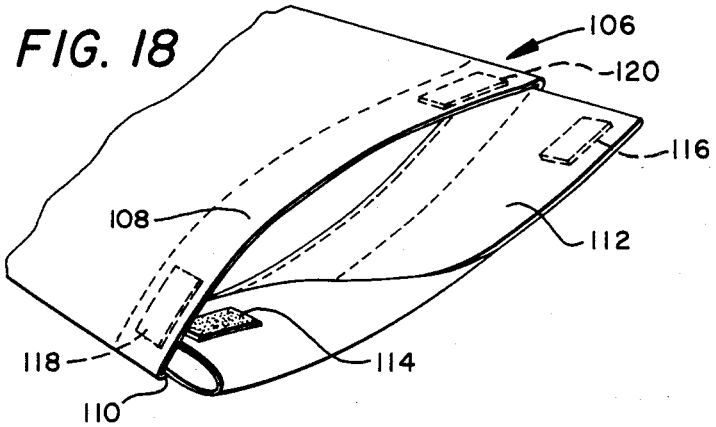
Figure 19:
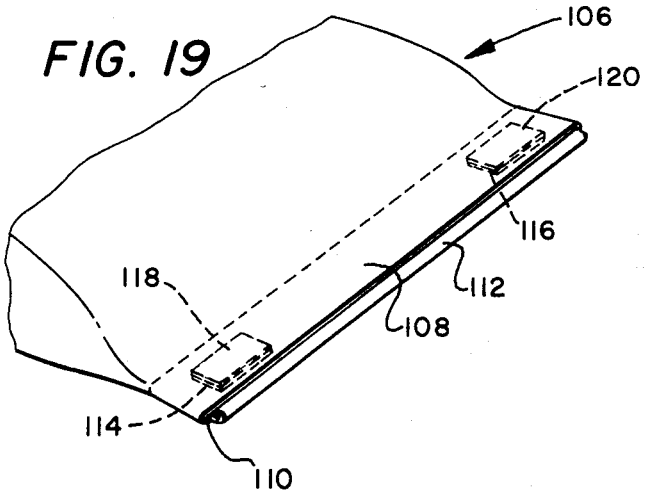

FIGS. 17–19 relate to an embodiment of the invention comprising a foldable flap with pressure actuated, releasable end fasteners. Referring to FIG. 17, pillow case 106 is a modified open-end pillow case wherein the opening into said pillow case is defined by upper and lower hemmed edges 108, 110. Lower hemmed edge 110 has a connected flap member 112 to which two releasable fastener strips 114, 116 are attached on its downward facing side when fully extended as shown in FIG. 17. Releasable fastener strips 118, 120 are attached to the inwardly facing surface of upper hemmed edge 108 so as to be oppositely disposed to releasable fastener strips 114, 116, respectively, when flap member 112 is folded under upper hemmed edge 108 as shown in FIG. 18. Referring to FIG. 18, after a pillow (not shown) is inserted into pillow case 106 between upper and lower hemmed edges 108, 110, releasable flap member 112 is folded upwardly and inserted under upper hemmed edge 108 so that releasable fastener strips 114, 116 are brought into facing and contacting alignment with releasable fastener strips 118, 120, respectively. Referring to FIG. 19, hemmed edges 108, 110 are pressed or pinched together, causing the opposed releasable fastener strips to become firmly engaged, thereby effectively but releasably securing the pillow within pillow case 106.

It is therefore apparent upon reading this disclosure in view of the accompanying drawings that the bed linens disclosed herein offer significant advantages that have not previously been disclosed or appreciated. Other alterations and modifications of the invention may become apparent upon reviewing this disclosure, and it is intended to cover all such alterations and modifications as fall within the scope of the appended claim.

What is claimed is:

1. A fitted bedsheet prepared from a substantially rectangular panel, a pair of opposed side panels formed integrally with said central panel, and a pair of opposed end panels formed integrally with said central panel, said bedsheet adapted to be fitted to an underlying mattress by means of a pressure actuated, releasable corner closure at at least one corner thereof, wherein said opposed side panels and said opposed end panels each comprise a folded top edge adjacent said central panel and a bottom edge that extends downwardly when said bedsheet is draped over a mattress, the distance between the top and bottom edges of at least one of said side panels being approximately twice the distance between the top and bottom edges of said end panels, and wherein the two corners of said bedsheet adjacent said wider side panel further comprise a first split perpendicularly disposed between said bottom edge and said top edge of said end panel in alignment with said top edge of said wider side panel, and a second split disposed parallel to said first split about halfway between said first split and the bottom edge of said wider side panel, said first split and said second split defining a first flap appended to the end of said side panel and said second split and said bottom edge defining a second flap appended to the end of said wider side panel, a first pressure adherent, releasable fastener strip disposed adjacent the end of said first flap opposite said side panel and fixedly attached to the downward facing surface of said flap, a second pressure adherent, releasable fastener strip disposed between said second split and the bottom edge of said wider side panel adjacent the end of said second flap opposite said side panel, a third pressure adherent, releasable fastener strip perpendicularly disposed between the top and bottom edges of said end panel adjacent said first split and fixedly attached to the upward facing surface thereof, and a fourth pressure adherent, releasable fastener strip perpendicularly disposed between the top and bottom edges of said end panel at a distance from said first split not greater than the length of said first flap, said first flap being adapted to be wrapped around the corner of a mattress to be brought into facing and substantially coextensive contacting alignment with said fourth fastener strip with said first flap overlying the portion of said end panel between said first split and said fourth fastener strip, and said second flap being adapted to wrap around the corner of a relatively wider mattress so that said second fastener strip can be brought into facing and substantially coextensive contacting alignment with said third fastener strip.

* * * * *